US008523439B2

(12) United States Patent
Ross

(10) Patent No.: US 8,523,439 B2
(45) Date of Patent: Sep. 3, 2013

(54) ELASTIC DRAWSTRING TRASH BAG

(75) Inventor: Michael A. Ross, Dallas, TX (US)

(73) Assignee: Poly-America, L.P., Grand Prairie, TX (US)

( * ) Notice: Subject to any disclaimer, the term of this patent is extended or adjusted under 35 U.S.C. 154(b) by 509 days.

(21) Appl. No.: 12/414,560

(22) Filed: Mar. 30, 2009

(65) Prior Publication Data

US 2010/0247002 A1 Sep. 30, 2010

Related U.S. Application Data

(63) Continuation-in-part of application No. 12/262,027, filed on Oct. 30, 2008.

(51) Int. Cl.
*B65D 33/28* (2006.01)

(52) U.S. Cl.
USPC ..... 383/75

(58) Field of Classification Search
USPC ..... 383/75; 220/495.11; 248/99
See application file for complete search history.

(56) References Cited

U.S. PATENT DOCUMENTS

| | | | | |
|---|---|---|---|---|
| 3,010,640 | A * | 11/1961 | Kugler | 383/75 |
| 3,029,853 | A * | 4/1962 | Piazze | 383/75 |
| 3,738,567 | A * | 6/1973 | Ruda | 383/75 |
| 4,762,430 | A | 8/1988 | Bullard | |
| 5,133,607 | A | 7/1992 | Bonke | |
| 5,265,962 | A * | 11/1993 | Ogawa et al. | 383/75 |
| 6,059,458 | A | 5/2000 | Belias et al. | |
| 6,394,651 | B2 | 5/2002 | Jackson | |
| 6,585,415 | B2 * | 7/2003 | Malaspina | 383/75 |
| 6,921,202 | B2 | 7/2005 | Raterman | |
| 6,939,042 | B2 | 9/2005 | Rusnak et al. | |
| 6,994,469 | B2 | 2/2006 | Sleight | |
| 7,137,737 | B2 | 11/2006 | Schneider | |
| 2006/0165319 | A1 * | 7/2006 | Patridge et al. | 383/107 |

FOREIGN PATENT DOCUMENTS

| | | | |
|---|---|---|---|
| DE | 19636511 | A1 * | 3/1998 |
| EP | 978459 | A1 * | 2/2000 |
| WO | WO 2006050576 | A1 * | 5/2006 |

* cited by examiner

*Primary Examiner* — Jes F Pascua
(74) *Attorney, Agent, or Firm* — Brandon J. Lee

(57) ABSTRACT

The present invention relates to polymeric bags, particularly polymeric drawstring trash bags. The present invention comprises a trash bag having an elastic drawstring. The elastic drawstring trash bag features a short seal and an inner seal at each upper corner of the drawstring trash bag. The short seal and inner seal are separated by a small unsealed area. The inner seal serves to reduce the upper opening of the drawstring trash bag, while the elastic drawstring utilized with the bag provides a bag that allows the bag to fit snugly on many common trash receptacles.

11 Claims, 3 Drawing Sheets

ELASTIC DRAWSTRING TRASH BAG

CROSS-REFERENCE TO RELATED APPLICATIONS

Figure 1:
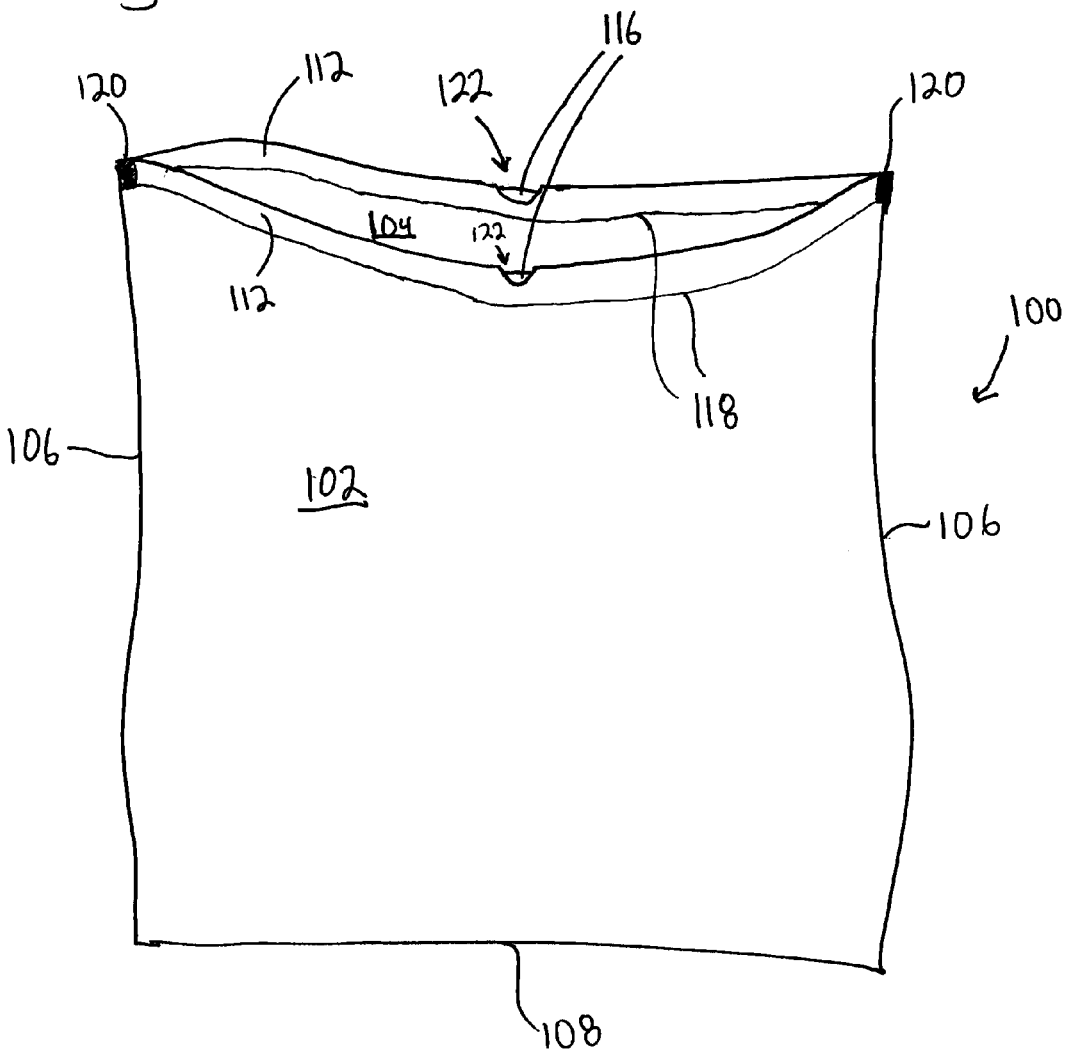
Fig 1 (Prior Art)

This is a continuation-in-part application of application Ser. No. 12/262,027 filed Oct. 30,2008.

BACKGROUND OF THE INVENTION

1. Field of the Invention

The present invention relates to improvements in the construction and manufacture of polymeric bags. In particular, the present invention relates to improvements in the construction and manufacture of drawstring-type polymeric bags, especially polymeric trash bags.

2. Description of the Related Art

Polymeric bags are ubiquitous in modern society, available in a variety of different combinations of materials, capacities, thicknesses, dimensions and colors. Such bags are used for a variety of purposes including for long-term storage, food storage and trash collection. In response to consumer demand, manufacturers of polymeric bags have developed innovations over the years to improve the utility and performance of polymeric bags. The present invention is of particular interest to polymeric bags used for trash collection and the method for securely closing and carrying such bags. Furthermore, the present invention provides advantages when applying such bags to trash receptacles.

The utility and desirability of polymeric trash bags is primarily driven by the convenience of securely closing and carrying a particular trash bag after filling it with debris. Over the years, several different methods have been commonly available, each method having certain advantages and disadvantages. One of the oldest methods for securing a trash bag is to provide a twist-tie to accompany the bag, allowing a consumer to bunch the upper opening of the bag together after filling. The twist-tie may be used to hold the bunched plastic together, securing the bag for disposal.

Another common configuration is the multi-flap bag, also commonly known as a wave-cut bag, where the top edges of the bag are cut in a wave-like pattern to provide two or more flaps extending upward from the top of the bag. These flaps allow the user to tie the opposing flaps together, securing the contents of the bag inside while also providing a convenient handle for carrying the filled bag.

As the name suggests, drawstring bags utilize drawstrings, also known as draw tapes, which are incorporated into the bag design. In particular, a pair of drawstrings may be enclosed within two hems running along the top edges of the panels forming the trash bag. In the drawstring trash bags known in the prior art, a pair of short seals, located near the upper corners of the bag, are formed by applying heat and pressure to weld the drawstrings and the panels of the bag together. After the ends of the drawstrings are securely anchored within the hems to the upper corners of the bag, the drawstring can be pulled through a pair of centrally located cutouts to close the opening of the bag, securing the trash within while also providing a convenient handle for carrying the filled bag.

It would be desirable to offer improved versions of drawstring bags versus what is known in the prior art. For example, as discussed herein, it is desirable to provide drawstring trash bags with a reduced opening width with an elastic drawstring thereby allowing the upper opening of the bag to fit tightly over the upper edge of a trash receptacle. The present invention addresses this need and provides additional advantages that will more fully discussed herein.

SUMMARY OF THE INVENTION

The present invention is directed toward an improved construction of a drawstring trash bag. Specifically, the present invention provides a drawstring trash bag having a first panel and a second panel joined along three edges to form the bag. The bag is provided with hems along the upper edges of the respective panels, each hem containing a drawstring.

At the upper corners of the drawstring trash bag, a short seal is applied. The short seals weld the first panel, the second panel, and the two drawstrings together. Additionally, an inner seal is spaced apart from each respective short seal along the upper opening of the improved elastic drawstring trash bag. The inner seals also weld the first panel, the second panel, and the two drawstrings together.

Certain embodiments of the present invention include elastomers in the composition of the drawstring providing both the ability for the drawstring to stretch, but more importantly to allow the drawstring contract after it expands. This allows the drawstring trash bag to be stretched over a trash receptacle while the elastic drawstrings create a snug fit around the outside of the receptacle.

It is contemplated that the present invention may be utilized in ways that are not fully described or set forth herein. The present invention is intended to encompass these additional uses to the extent such uses are not contradicted by the appended claims. Therefore, the present invention should be given the broadest reasonable interpretation in view of the present disclosure, the accompanying figures, and the appended claims.

BRIEF DESCRIPTION OF THE RELATED DRAWINGS

A full and complete understanding of the present invention may be obtained by reference to the detailed description of the present invention and preferred embodiment when viewed with reference to the accompanying drawings. The drawings can be briefly described as follows.

FIG. 1 provides a perspective view of a drawstring trash bag as known in the prior art to provide context for understanding the present invention.

Figure 2:
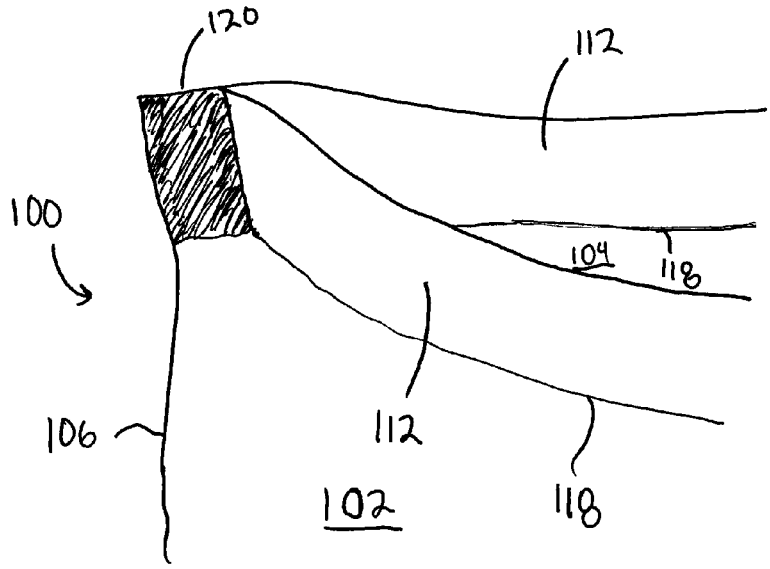
Fig 2 (Prior Art)

FIG. 2 provides an enlarged perspective view of the upper corner of a drawstring trash bag as known in the prior art.

Figure 3:
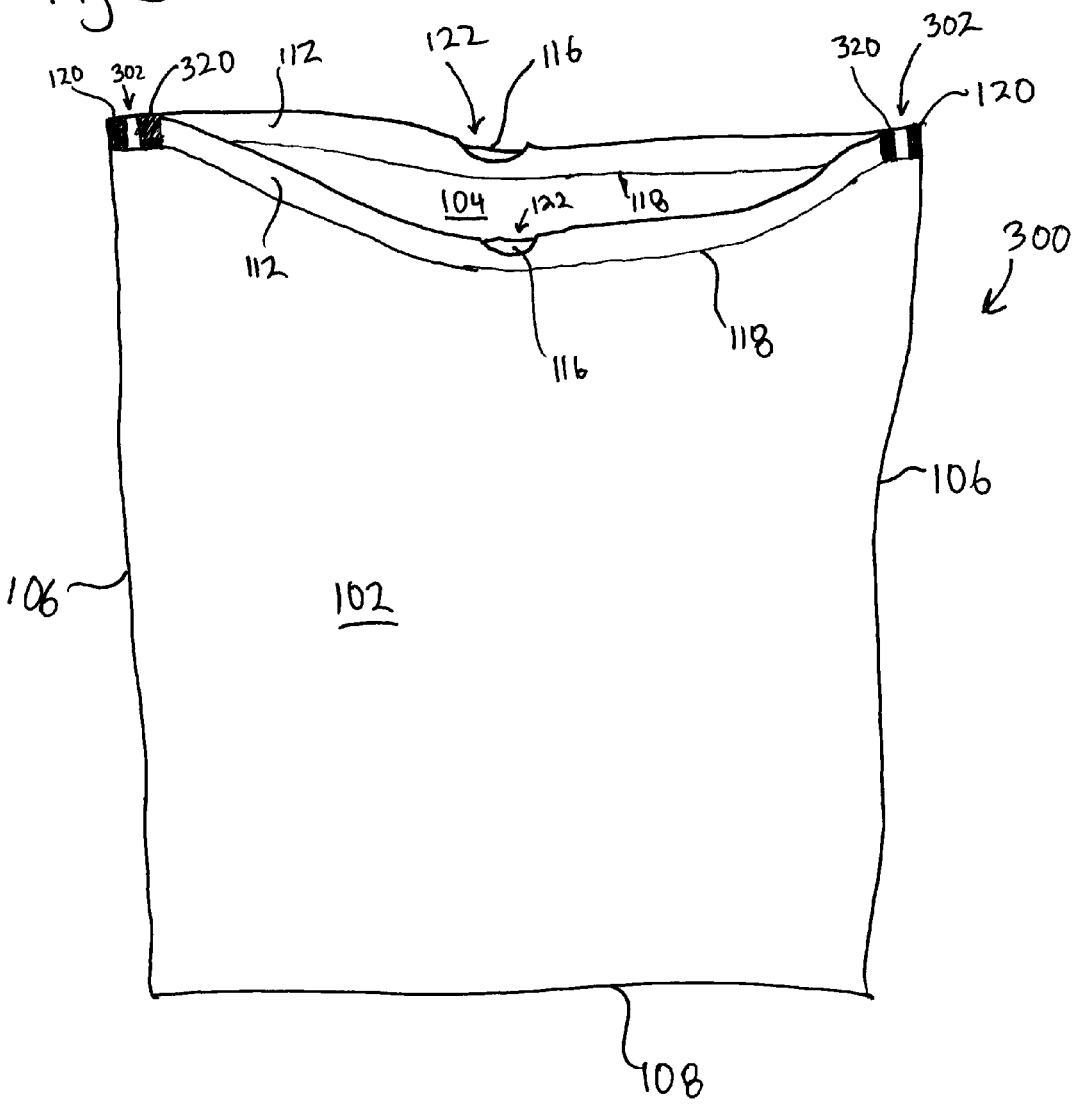

FIG. 3 provides an enlarged perspective view of the upper corner of a drawstring trash bag as contemplated by one embodiment of the present invention.

Figure 4:
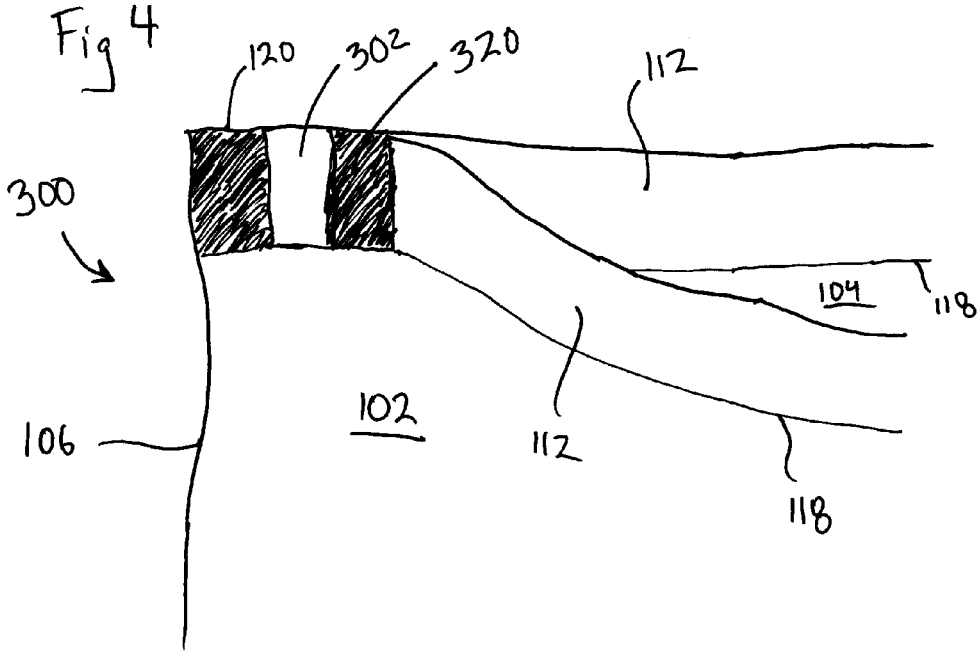

FIG. 4 provides a perspective view of a drawstring trash bag as contemplated by one embodiment of the present invention.

DETAILED DESCRIPTION OF THE INVENTION

The present disclosure illustrates one or more preferred embodiments of the present invention. It is not intended to provide an illustration or encompass all embodiments contemplated by the present invention. In view of the disclosure of the present invention contained herein, a person having ordinary skill in the art will recognize that innumerable modifications and insubstantial changes may be incorporated or otherwise included into the depicted embodiments without diverging from the spirit of the invention. Therefore, it is understood that the present invention is not limited to the embodiments disclosed herein. Rather, the scope of the invention shall be broadly defined by the appended claims which are intended to more fully and accurately encompass the invention to the fullest extent possible. However, it is fully appreciated that the use of certain terminology shall not be construed to conclusively limit the scope of protection if otherwise within the spirit of the present invention.

Referring initially to FIG. 1, a perspective view of a drawstring trash bag 100 as known in the prior art is depicted to provide context for an appreciation of the present invention. As depicted in FIG. 1, the drawstring trash bag 100 is comprised of a first panel 102 and a second panel 104 joined along three sides. When manufactured using a blown-film extrusion process, as is typical, a drawstring trash bag 100 may be formed from a flattened tube, the bottom 108 defined by a folded edge of the flattened tube, the sides 106 sealed using any one of several methods that are well known in the prior art. The various types of construction of drawstring trash bags 100 are well-known in the art and the particular method of manufacture is not intended to limit the present invention in any way.

The drawstring trash bag 100 as depicted in FIG. 1 is provided with a pair of drawstrings 116 enclosed within the hems 112 of the drawstring trash bag 100. As known in the prior art, the top portions of the first panel 102 and the second panel 104 are folded and sealed to form the hems 112. The hem seals 118 run the width of the bag with the drawstrings 116 within the hems 112. It is then necessary to provide a pair of short seals 120 at the upper corners of the drawstring trash bag 100, sealing the first panel 102, second panel 104 and the pair of drawstrings 116 together.

The short seals 120 must be sufficiently strong to allow a consumer to pull the drawstrings 116 through the cut-outs 122 to close the upper opening of the drawstring trash bag 100. If the short seals 120 are not strong enough, the drawstrings 116 will dislodge, eliminating the benefits of the drawstring trash bag 100. Typically, the short seals 120 are rectangular in shape, having a width from one-eighth to one-half of an inch and the height of the hems 112, the distance from an upper opening of the bag to the bottom of the hem seal 118.

Looking now at FIG. 2, an enlarged perspective view of an upper corner of a prior art drawstring trash bag 100 is provided to provide additional context for the present invention. As can be seen, the short seal 120 welds together the first panel 102, the second panel 104, and the drawstrings 116 contained within the hems 112. As discussed above, it is critical that the short seals 120 be of sufficient strength to permanently weld the front panel 102, second panel 104, and drawstrings 116 together so the drawstring does not dislodge when pulled by a consumer.

FIG. 3 depicts an embodiment of the present invention. This particular embodiment of an improved elastic drawstring trash bag 300 includes all of the aspects described with respect to FIG. 1, but adds an additional inner seal 320 spaced apart from the short seal 120 and positioned along the upper hems 112 of the improved elastic drawstring trash bag 300. The inner seals 320 weld the first panel 102, the second panel 104, and the drawstrings 116 together much like the short seal 120 at the corners of the improved elastic drawstring bag 300. In preferred embodiments, it is contemplated that the inner seals 320 extend from the upper edge of the drawstring trash bag 300 to the hem seal 118 of the upper hems 112 while being substantially rectangular in shape.

The inner seals 320 essentially reduce the width of the upper opening of the improved elastic drawstring trash bag 300. However, when an individual stretches the upper opening around the upper rim of a trash receptacle, the polyethylene material used for the first panel 102 and second panel 104 stretches, allowing the improved elastic drawstring trash bag 300 to be placed over the upper rim of a trash receptacle, even if the trash receptacle is larger than the upper opening of the improved elastic drawstring trash bag 300. Notably, prior art trash bags such as those depicted in FIG. 1 have traditionally utilized drawstrings that intentionally minimizes any potential stretching to ensure that an individual can pull the drawstring out without causing the drawstring to stretch and become useless. Therefore, the present invention utilizes drawstrings which may include elastomers to provide desirable elastic characteristics, controlled stretching properties, and additional advantages over the prior art.

In particular, elastomers included in the drawstrings 116 of the improved elastic drawstring trash bag 300 are specifically intended to allow a limited amount of stretching. The limited stretching allows the improved elastic drawstring trash bag 300 to fit over the rim of a trash receptacle, even if the circumference of the rim is larger than the reduced width (resulting from the inner seals 320). More importantly, after the improved elastic drawstring trash bag 300 is stretched over the rim of a trash receptacle, the elastomers in the drawstrings 116 cause the drawstrings 116 to contract to their original length, providing a tight fit of the drawstrings around the outside of the trash receptacle.

FIG. 4 provides an enlarged view of the upper corner of a drawstring trash bag 100 as contemplated by the present invention. As in FIG. 3, the short seal 120 and the inner seal 320 can be seen, with an unsealed area 302 located between the two areas. The inner seals 320 are likely to be substantially rectangular in shape, but it is not necessarily a requirement of the present invention. Typically, the inner seals 320 are approximately the same size and shape as the short seals 120. Therefore, the inner seals 320 may be approximately one-eighth to one-half inch when measured along the width of the bag and will typically span from the upper opening of the bag to the hem seals 118.

As noted, the embodiments depicted herein are not intended to limit the scope of the present invention. Indeed, it is contemplated that any number of different embodiments may be utilized without diverging from the spirit of the invention. Therefore, the appended claims are intended to more fully encompass the scope of the present invention.

I claim:

1. A drawstring trash bag comprising:

a first panel and a second panel, the first panel and the second panel joined along three edges of the first panel and the second panel, a fourth edge of the first panel and the second panel defining an upper opening of the drawstring trash bag, a first elastic drawstring provided within a first hem formed in the first panel along the upper edge of the drawstring trash bag, the first elastic drawstring being the only drawstring within the first hem, a second elastic drawstring provided within a second hem formed in the second panel along the upper edge of the drawstring trash bag, the second elastic drawstring being the only drawstring within the second hem, a first and second short seal, each short seal welding together the first panel, the first elastic drawstring, the second elastic drawstring and the second panel, wherein the first short seal is within a first upper corner area and proximate to a first side edge of the drawstring trash bag and the second short seal is within a second upper corner area and proximate to a second side edge of the drawstring trash bag, a first inner seal, the first inner seal welding together the first panel, the first elastic drawstring, the second elastic drawstring and the second panel, wherein the first inner seal is spaced inwardly from the first short seal, and the first upper corner area, defined by the first short seal and the first inner seal, is an inseparable portion of the first and second panel.

2. The drawstring trash bag of claim 1 further comprising:

a first drawstring access cutout centrally located along an upper edge of the first panel and a second drawstring access cutout centrally located along an upper edge of the second panel, the first and second elastic drawstrings being accessible through the respective first and second drawstring access cutouts.

3. The drawstring bag of claim 1, wherein the first short seal and the first inner seal are separated by a first unsealed area.

4. The drawstring bag of claim 1, wherein the first and second short seal are both substantially rectangular in shape and wherein the first inner seal is substantially rectangular in shape.

5. The drawstring bag of claim 1, wherein the first short seal and the first inner seal are of a substantially identical area.

6. A drawstring trash bag comprising:

a first panel and a second panel, the first panel and the second panel joined along three edges of the first panel and the second panel, a fourth edge of the first panel and the second panel defining an upper opening of the drawstring trash bag, a first elastic drawstring provided within a first hem formed in the first panel along the upper edge of the drawstring trash bag, the first elastic drawstring being the only drawstring within the first hem, a second elastic drawstring provided within a second hem formed in the second panel along the upper edge of the drawstring trash bag, the second elastic drawstring being the only drawstring within the second hem, a first and second short seal, each short seal welding together the first panel, the first elastic drawstring, the second elastic drawstring and the second panel, wherein the first short seal is within a first upper corner area of the drawstring trash bag and the second short seal is within a second upper corner area of the drawstring trash bag, a first and second inner seal, each inner seal also welding together the first panel, the first elastic drawstring, the second elastic drawstring and the second panel, wherein the first inner seal is along the upper edge of the drawstring trash bag and inwardly spaced from the first short seal and the second inner seal is along the upper edge of the drawstring trash bag and inwardly spaced from the second short seal, the first upper corner area, defined by the first short seal and the first inner seal, is an inseparable portion of the first and second panel, and the second upper corner area, defined by the second short seal and the second inner seal, is an inseparable portion of the first and second panel.

7. The drawstring trash bag of claim 6 further comprising:

a first drawstring access cutout centrally located along an upper edge of the first panel and a second drawstring access cutout centrally located along an upper edge of the second panel, the first and second drawstrings being accessible through the respective first and second drawstring access cutouts.

8. The drawstring bag of claim 6, wherein the first short seal and the first inner seal are separated by a first unsealed area, and the second short seal and the second inner seal are separated by a second unsealed area.

9. The drawstring bag of claim 6, wherein the first and second short seal are both substantially rectangular in shape and wherein the first and second inner seal are both substantially rectangular in shape.

10. The drawstring bag of claim 6, wherein the first short seal and the first inner seal are of a substantially identical area and the second short seal and the second inner seal are of a substantially identical area.

11. The drawstring bag of claim 6, further comprising:

a first hem seal defining the bottom of the first hem, the first hem seal extending horizontally between opposite vertical edges of the first panel, and a second hem seal defining the bottom of the second hem, the second hem seal extending horizontally between opposite vertical edges of the second panel.

* * * * *